US006095051A

United States Patent [19]

Saxby

[11] Patent Number: 6,095,051

[45] Date of Patent: Aug. 1, 2000

[54] SELF LOADING GUN CARTRIDGE

[76] Inventor: Michael Ernest Saxby, 82 Cowdray Park Road, Little Common, Bexhill-on-Sea East Sussex TN39 4EZ, United Kingdom

[21] Appl. No.: 09/219,471

[22] Filed: Dec. 23, 1998

[30] Foreign Application Priority Data

| | | | |
|---|---|---|---|
| Aug. 13, 1998 | [GB] | United Kingdom | 9817515 |
| Sep. 14, 1998 | [GB] | United Kingdom | 9819929 |

[51] Int. Cl.[7] ..... F42B 8/02

[52] U.S. Cl. ..... 102/444; 102/440; 102/430

[58] Field of Search ..... 102/444, 445, 102/446, 447, 440, 439, 430

[56] References Cited

U.S. PATENT DOCUMENTS

| | | | |
|---|---|---|---|
| 740,790 | 10/1903 | Young et al. | 102/470 |
| 3,477,375 | 11/1969 | Barr | 102/45 |
| 3,528,662 | 9/1970 | Merchant et al. | 273/106.5 |
| 3,782,286 | 1/1974 | Jones et al. | 102/41 |
| 3,837,284 | 9/1974 | Waldeisen | 102/92 |
| 3,952,662 | 4/1976 | Greenlees | 102/92.7 |
| 4,128,059 | 12/1978 | Black | 102/92.7 |
| 4,204,474 | 5/1980 | Mizelle | 102/92.7 |
| 4,637,616 | 1/1987 | Whiting | 273/418 |
| 4,686,905 | 8/1987 | Szabo | 102/444 |
| 4,823,702 | 4/1989 | Woolsey | 102/502 |
| 4,862,805 | 9/1989 | Szabo | 102/444 |
| 5,016,536 | 5/1991 | Brighton | 102/430 |
| 5,359,937 | 11/1994 | Dittrich | 102/430 |
| 5,492,063 | 2/1996 | Dittrich | 102/430 |
| 5,677,505 | 10/1997 | Dittrich | 89/14.5 |
| 5,700,972 | 12/1997 | Saxby | 102/440 |
| 5,962,805 | 10/1999 | Saxby | 102/440 |

FOREIGN PATENT DOCUMENTS

| | | |
|---|---|---|
| 473758 | 11/1992 | European Pat. Off. . |
| 1263522 | 2/1972 | United Kingdom . |
| 1309362 | 3/1973 | United Kingdom . |
| 1371482 | 10/1974 | United Kingdom . |
| 2284252 | 5/1995 | United Kingdom . |
| WO 91/14916 | 10/1991 | WIPO . |
| WO 95/05573 | 2/1995 | WIPO . |

*Primary Examiner*—Thomas Price
*Assistant Examiner*—James S. Bergin
*Attorney, Agent, or Firm*—Lahive & Cockfield, LLP

[57] ABSTRACT

The invention provides a cartridge for use in a firearm, the cartridge having a projectile mounted in or on a nose portion thereof; the cartridge interior communicating with the projectile via a gas passage, a valve for controlling propellant gas flow through the gas passage, and a movable member which upon firing is propelled rearwardly from the cartridge against a breech block of the firearm by the pressure of propellant gas within the cartridge so as to recycle the firearm; characterized in that the valve is arranged to close in order to stop or substantially reduce the flow of propellant gas through the said gas passage after the projectile has been fired from the cartridge, thereby to facilitate rearwards propulsion of the movable member.

29 Claims, 5 Drawing Sheets

SELF LOADING GUN CARTRIDGE

BACKGROUND OF THE INVENTION

The present invention relates to ammunition, particularly non-lethal ammunition intended for use in training and war games. More especially, the invention relates to a telescopic cartridge in which rearwards movement of a portion of the cartridge is used to initiate the recycling of an automatic or semi-automatic firearm.

Low energy cartridges for cycling self loading guns are widely known. For example, U.S. Pat. No. 5,677,505 and EP-A-0473758 relate to a two part cartridge which has a casing slidable relative to a plug at the forward end of the cartridge. When the cartridge is fired, force provided by the propellant gas is employed to urge the casing back against the breech-block and recycle the weapon. A cross-sectional view of one embodiment of such a cartridge is illustrated in FIG. 1 of the drawings. The cartridge 2 comprises a cartridge case 4 containing a primer 6 in the base thereof to provide the propulsion energy. A propellant 8 may be contained in the cavity 10 of the case 4 to provide additional energy. A flange 12 is provided at the front end of the case 4. A one piece plug 16 is inserted into the end of the cartridge case 4. The inner diameter 20 of the rear of the plug 16 is equal to the inner diameter of the cartridge case 4. The outer diameter 18 of the front of the plug 16 is equal to the outer diameter of the cartridge case 4. Longitudinal orifices 22 extend from the rear of the plug to the cylindrical recess 24 into which the bullet 26 sits. An inward step 28 is defined between the portions of differing diameter.

On ignition of the primer 6, gas is generated by the primer and/or the propellant. The plug may be restricted in its movement forward by the configuration of the barrel of the gun. Therefore, the cartridge case 4 moves rearwardly along the plug 16 until its movement is restricted by interaction of the flange 12 of the cartridge case 4 with the inward step 28 of the plug 16. Concurrently, the gas flow through the orifices 22 projects the bullet out of the recess 24 and through the barrel of the gun.

The operation of cartridges such as the cartridge shown in FIG. 1 using low energy explosive primers to cycle self loading guns is characterised by using high pressure propellant gas to force the bullet out of the cartridge and through the barrel of the gun at approximately the same time as the gun recycles. However, when the bullet is discharged at the same time as gun recycling, variations in gas pressure and in the orientation of the cartridge components may change the gas flow to the bullet. Thus the bullet is projected from the cartridge case and through the barrel at varying velocities. Moreover, at the same time that the bullet is travelling through the barrel, the recycling action means that the gun components are moving with respect to each other. The combination of variable velocity and gun movements lead to inaccuracies in shooting. When such cartridges are used to fire marking bullets in personnel training, the velocity variations can cause injury when the marking bullet is discharged at too high a velocity.

Alternatively, cartridges have been developed which use high pressure propellant gas to trigger the gun's recycling mechanism before the bullet is ejected from the cartridge and out of the barrel. When the recycling mechanism is operated prior to the discharge of the bullet, the problems mentioned above are accentuated due to the delayed discharge of the bullet.

SUMMARY OF THE INVENTION

It is an object of the present invention to provide a gun cartridge which can recycle a firearm, which has increased accuracy and safety, which reduces the movement of a gun while the bullet is in the gun barrel, and which releases the bullet at a controlled pressure to provide a constant applied velocity.

It is a further object of the invention to provide a cartridge in which the flow of expanding gas through the cartridge after detonation is controlled by means of a valve in order to ensure that the projectile (e.g. a bullet) is ejected from the cartridge and preferably also from the barrel of the gun before recycling takes place.

Accordingly, in a first aspect, the invention provides a cartridge for use in a firearm, the cartridge having a projectile (e.g. a bullet) mounted in or on a nose portion thereof, the cartridge interior communicating with the projectile via a gas passage; valve means for controlling propellant gas flow through the gas passage to the projectile, and a movable member which upon firing is propelled rearwardly from the cartridge against a breech block of the firearm by the pressure of propellant gas within the cartridge so as to recycle the firearm; characterised in that the valve means is arranged to close in order to stop or substantially reduce the flow of propellant gas through the said gas passage after the projectile has been fired from the cartridge, thereby to facilitate rearwards propulsion of the movable member.

In a further aspect, the invention provides a method of recycling a firearm comprising loading the firearm with a cartridge fitted with a projectile; the cartridge interior communicating with the projectile via a gas passage, valve means for controlling propellant gas flow through the gas passage to the projectile, and a movable member which is propelled rearwardly from the cartridge against a breech block of the firearm by the pressure of propellant gas within the cartridge upon firing so as to recycle the firearm; characterised in that the valve means is arranged to close in order to stop or substantially reduce the flow of propellant gas through the said gas passage after the projectile has been fired from the cartridge.

A major advantage of the present invention is that the bullet is discharged before significant rearwards movement of the movable member has taken place. Although the rate of expansion of propellant gas inside the cartridge upon ignition is very high, such that the pressure required to move the firearm's reloading mechanism and the pressure required to move the bullet are reached almost simultaneously, the larger mass of the firearm's reloading mechanism means that acceleration of the moving parts of the mechanism is slow compared to the acceleration of the bullet. Once the bullet has been ejected from the cartridge, the valve means is arranged to close thereby preventing gas from passing through the nose portion. Thus, the full force of the expanding gas is then used to drive the movable member rearwardly to recycle the gun. By ensuring that the bullet is discharged before the gun is recycled, any movement of the gun barrel resulting from vibration of the gun during recycling is minimised or avoided, and it has been found that this greatly increases the accuracy of the firing. Thus the cartridge of the invention is distinguished from many known types of cartridge in which a movable member such as a piston is thrown rearwardly against the breech block before the propellant gas is allowed to come into contact with the projectile. According to the invention, the cartridge and firearm assembly are set up such that the force needed to eject the projectile is less than the force needed to move the breech block to bring about recycling. This can be achieved for a given firearm or cartridge by controlling the quantity and strength of the pyrotechnic composition in the cartridge and the resistance to movement of the breechblock. A further advantage of the invention is that the terminal velocity of the projectile (e.g. bullet) can be controlled by adjusting the valve means to allow more or less propellant gas to reach the projectile before the gas passage through the nose portion is closed.

The movable member is typically in the form of a piston or cylinder slidably engaged with a cylinder or piston extending rearwardly from the nose portion of the cartridge. For example, the movable member can be in the form of a piston slidably received in a sleeve or cylinder extending rearwardly from the nose portion.

The valve means is preferably associated with the movable member. For example, the valve means can be associated with a piston slidably received in a sleeve or cylinder extending rearwardly from the nose portion.

In one preferred embodiment, the invention provides a cartridge having a projectile (e.g. a bullet) mounted in or on a nose portion thereof, the nose portion having a gas passage therethrough communicating with a trailing surface of the projectile; a sleeve extending rearwardly from the nose portion, and a hollow piston slidably disposed within the sleeve; an expansion chamber being provided within the sleeve between the hollow piston and the nose portion, one or more gas channels being provided between the hollow interior of the piston and the expansion chamber; and valve means associated with the piston for closing the gas passage through the nose portion; wherein the valve means is configured such that it is in an open position prior to ignition of the cartridge, whereupon after ignition, expanding gas passing from the hollow interior of the piston through or around the valve means serves to expel the projectile, and expanding gas passing into the expansion chamber moves the piston rearwardly in the sleeve, the rearward movement of the piston causing the valve means to move to a closed position.

Preferably the projectile (e.g. bullet) is mounted in or on a recessed seat in the nose portion, and the gas passage communicates with the recessed seat. The recessed seat is typically of a tapering configuration, the trailing end of the bullet being force-fitted into the seat. However, it will be appreciated that alternative arrangements for mounting the bullet or other projectile in or on the cartridge may be employed, for example, the projectile may sit across the recessed seat.

The valve means preferably comprises a spigot which extends forwardly of the piston and into the gas passage. The spigot can be provided with internal or external passages or channels which have openings that are blocked to prevent passage of expanding gas therealong when the spigot is moved rearwardly and into a closed position. The spigot and gas passage are preferably constructed such that at the rearmost extent of the travel of the piston, at least a portion of the spigot remains within the gas passage. The advantage of such an arrangement is that it prevents bending or pivoting of the piston relative to the sleeve as the piston is thrust rearwardly and thereby eliminates the risk of the base section of the piston bending relative to the axis of the assembly and missing the cartridge eject mechanism of the gun. It also ensures that maximum power is available to the piston throughout its movement, thus making the recycling of the gun more reliable.

Typically, when the valve means is in an open position, the leading end of the spigot extends forwardly of the gas passage and into the recessed seat. The leading end is preferably received within a recess in a trailing end of the projectile, for example within a hollow skirt portion at the trailing end thereof, the hollow skirt being defined by a generally cylindrical wall. The cylindrical wall can be held as a force fit between the spigot and a radially inner wall of the recessed seat when the valve means is in an open position, prior to ignition of the cartridge. Preferably, an annular chamber is formed between a trailing surface of the hollow skirt portion of the projectile, the spigot and a portion of the wall of the recessed seat, the annular chamber being in communication with the hollow interior of the piston (e.g. via an internal or external channel or passage in the spigot) when the valve means is in an open position. The spigot and bullet recess in the trailing end of the projectile arrangement allows for maximum movement of the piston to operate the guns recycling mechanism.

In one embodiment of the invention, the spigot has a passage extending therethrough, the passage communicating with the hollow interior of the piston, and through which passage the expanding gas can pass when the valve means is in an open position. The passage through the spigot preferably opens out into an annular chamber of the type defined above. The passage can have an axially extending portion communicating with a lateral opening into the annular chamber, the lateral opening being open to permit the expanding gas to pass therethrough when the valve means is in an open position, and closed to prevent the expanding gas from passing therethrough when the valve means is in a closed position. The axially extending portion of the passage typically communicates with the lateral opening via a laterally extending passage. The laterally extending passage preferably has a lateral opening at either end thereof into the annular chamber and the axially extending portion intersects the laterally extending passage at a point between the lateral openings. The axially extending portion preferably intersects the laterally extending passage at a point midway between the lateral openings.

In an alternative embodiment, the spigot is configured so as to allow expanding gas from the hollow interior of the piston to pass between a surface of the spigot and a wall of the gas passage through the nose portion when the valve means is in an open position. For example, the spigot can be configured to allow expanding gas to pass into an annular chamber of the type defined above. In this embodiment, the spigot can have a portion which is undersized with respect to the gas passage such that there is a clearance therebetween through which the expanding gas can pass. Preferably, the spigot is provided with an enlarged portion forwardly of the undersized portion, the enlarged portion fitting snugly in the gas passage to block the passage of gas when the valve means is in a closed position. Alternatively, the spigot can have one or more channels extending along the outer surface thereof along which the expanding gas can pass, the channels for example communicating with the annular chamber when the valve means is in an open position. Such channels can take the form of axial grooves. In this embodiment of the invention, typically the spigot and piston are configured such that the expanding gas passes from the hollow interior of the piston into the gas passage in the nose portion via the expansion chamber.

Discharging the projectile substantially before the gun cartridge recycles ensures that there is less movement of the gun while the projectile is in the barrel and thus ensures a more accurate aim. Moreover, the use of consistent gas pressure to discharge the bullet from the gun affords better shot to shot velocities.

The energy required to move the piston of a self loading gun is constant. The force developed in the cartridge to move the piston is therefore also constant. As the release rate and/or gas generation rate of the pyrotechnic composition is constant, the pressure and gas volume used to discharge the bullet from the gun is also constant. By using these constant parameters, variations in the amount of propellant and cartridge dimensions which so adversely effect all other known cartridges of the self cycling type are substantially reduced.

In another preferred embodiment, the invention provides a method in which a gun cartridge is used to recycle a self-loading firearm substantially after pressurised gas is used to expel a projectile from the gun cartridge, the gun cartridge comprising an outer casing and a piston associated with a spigot for controlling the flow of gas to the projectile, whereby as the flow of gas discharges the projectile from the gun cartridge, the gas displaces the piston relative to the outer casing until the spigot prevents the passage of gas leading to the projectile, so directing substantially all the gas between the outer casing and the piston, forcing the piston rearwardly and recycling the firearm.

BRIEF DESCRIPTION OF THE DRAWINGS

The invention will now be described in more detail with reference to the particular embodiments shown in the drawings in which.

DESCRIPTION OF THE PREFERRED EMBODIMENTS

Figure 1:
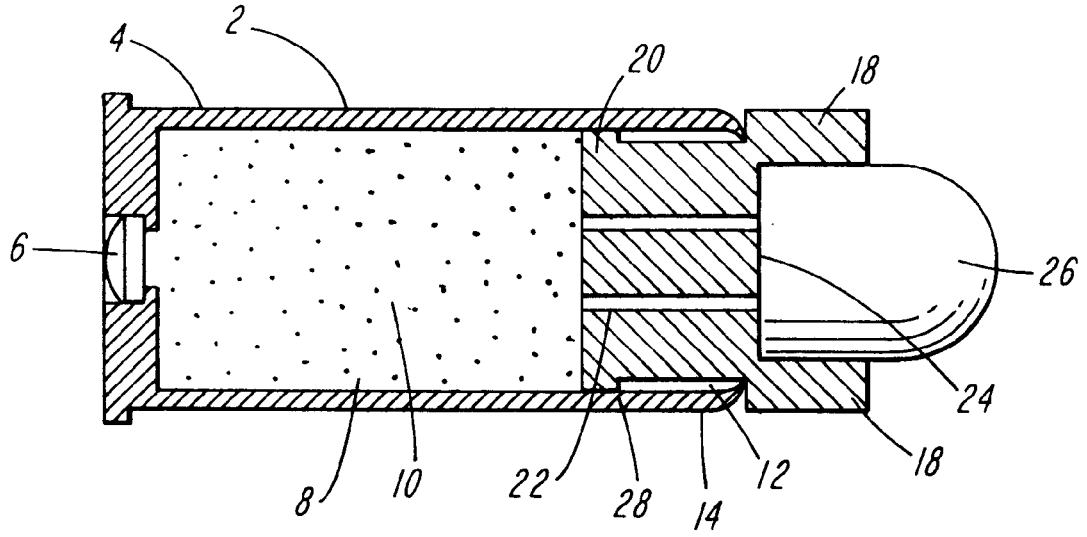
FIG. 1 is a longitudinal section through a known type of cartridge.
Figure 2A:
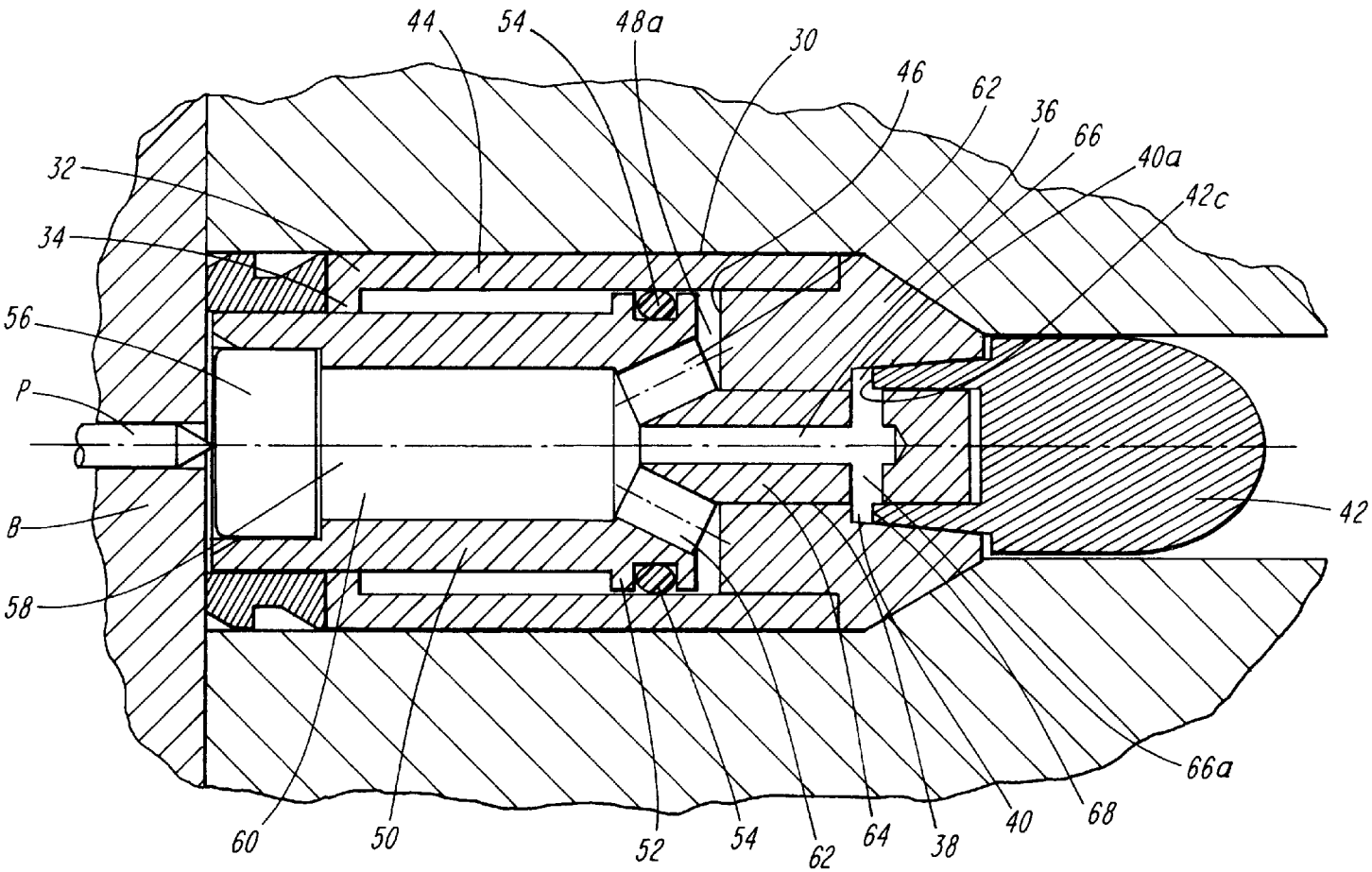
FIG. 2A is a longitudinal section through a gun cartridge, prior to firing, according to one embodiment of the invention.

A gun cartridge 30 according to the present invention is illustrated in FIG. 2A. The cartridge 30 comprises a cylindrical cartridge case 32 with an in-turned flange 34 at the rearward end. The forward end of the casing comprises a nose portion 36, which in this embodiment is in the form of a plug, from which sleeve 44 extends in a rearwards direction. The plug 36 has an axial bore or gas passage 38, the axial bore being stepped so that the larger diameter forward section of the bore 40 forms a recessed seat in which is receives the trailing end of a bullet 42.

The inner surface of the sleeve and the rearward surface 46 of the plug define a piston chamber 60. A piston 50 is slidably contained within the piston chamber 60 and has a pair of outwardly extending flanges 52 at its forward end. Nested between the flanges 52 and surrounding the piston is an O-ring 54 to provide a seal between the forward end of the piston and the inner surface of the casing.

A pyrotechnic composition 56 is housed at the rearward end of the piston 50. Extending from the pyrotechnic composition to the forward end of the piston is a first gas expansion chamber 58. At the head of the gas expansion chamber 58, gas channels 62 allow the flow of propellant gas from the first expansion chamber 58 into a second expansion chamber 48*a* (which corresponds to the expansion chamber defined in the claims appended hereto), which is defined by the space between the piston head and the rearward surface 46 of the plug.

A spigot 64 extends from the forward end of the piston and is slidably contained within the axial bore or gas passage 38 of the plug. The spigot has an axial gas passage 66 therethrough which provides a gas flow path from the gas first expansion chamber 58 via laterally extending passage 66*a* to outlets 68. Outlets 68 open out into the larger diameter forward section 40 of the bore 38 immediately behind the rear edge 42*c* of the hollow cylindrical skirt portion of the bullet 42. The annular space 40*a* formed between the rear edge 42*c* of the bullet, the outer wall of the spigot and the axially facing surface 36*a* of the plug functions as a third expansion chamber.

In operation, the pyrotechnic composition is activated by the firearm's firing pin P and the propellant gas produced expands into the first gas expansion chamber 58 and through the passage 66 in the spigot 64 to the third expansion chamber 40*a*, thereby discharging the bullet 42 from its seat. At substantially the same instant, gas flows through the gas channels 62 between the first gas expansion chamber 58 and the second expansion chamber 48*a* at the front of the piston. The pressurised gas forces the piston to move rearwardly relative to the outer casing 32, thereby urging the spigot 64 in a rearwards direction against the breech block B. As a result of the rearward displacement of the piston and spigot, the outlets 68 are substantially sealed by the inner surface of the axial bore 38 so preventing the flow of gas to the forward section of the bore 40 (see FIG. 3). Consequently, the full force of the remaining propellant gas is directed through the gas channels 62 as the piston shoots backwards against the breech block to recycle the firearm. The flange 52 on the forward end of the piston engages with the flange 34 on the rearward end of the casing 32, therefore preventing further rearward motion of the piston (FIG. 4) and expulsion of the piston from the cartridge casing.

Figure 3:
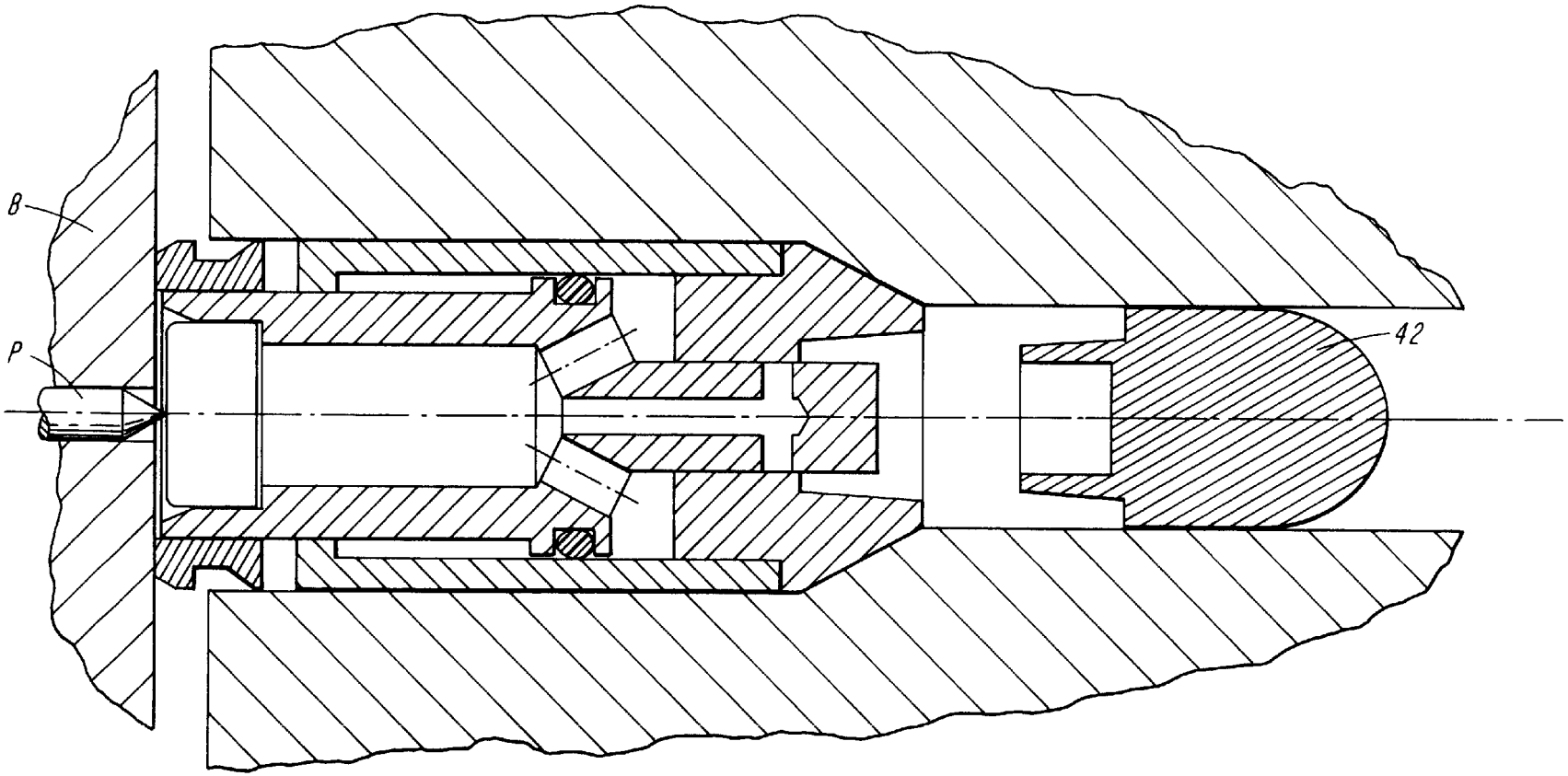
FIG. 3 is a longitudinal section through the gun cartridge shown in FIG. 2A after the cartridge has been fired and the bullet has left the cartridge but prior to recycling of the cartridge; and, FIG. 4 is a longitudinal section through the gun cartridge illustrated in FIGS. 2A and 3 after the cartridge has recycled.
Figure 4:
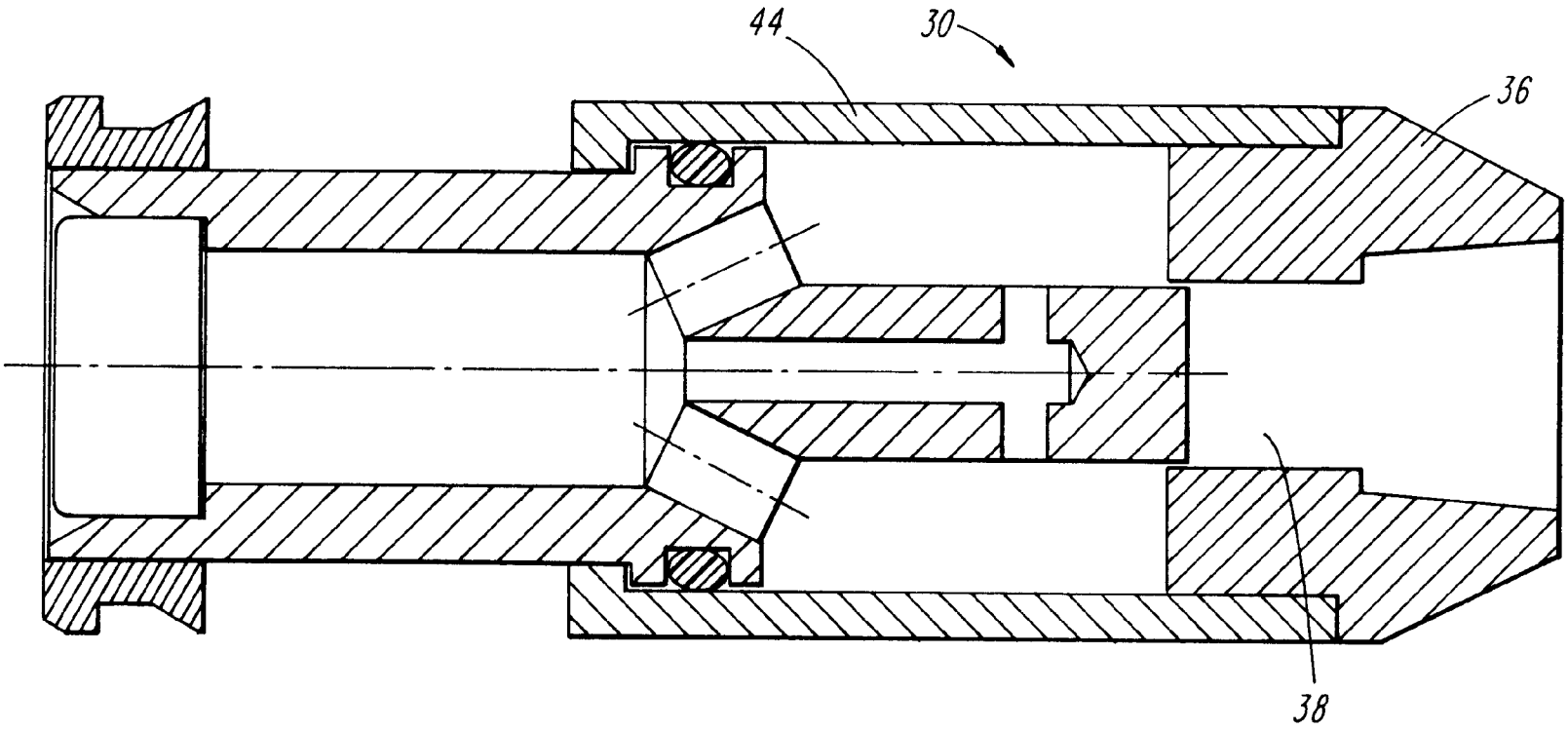

As can be seen from FIGS. 2A, 3 and 4, at least a portion of the spigot 64 remains in the bore 38 after firing. An advantage of this is that it prevents relative pivoting movement taking place between the piston and the casing as the piston moves rearwardly out of the casing, eliminating the risk of the base section of the piston bending relative to the axis of the assembly and missing the cartridge eject mechanism of the gun.

A further and most significant advantage of the arrangement shown in the Figures is that because the bullet is ejected before significant rearwards movement of the piston has taken place, and leaves the barrel of the gun before the gun is recycled, the accuracy of the firing is greatly increased.

Figure 2B:
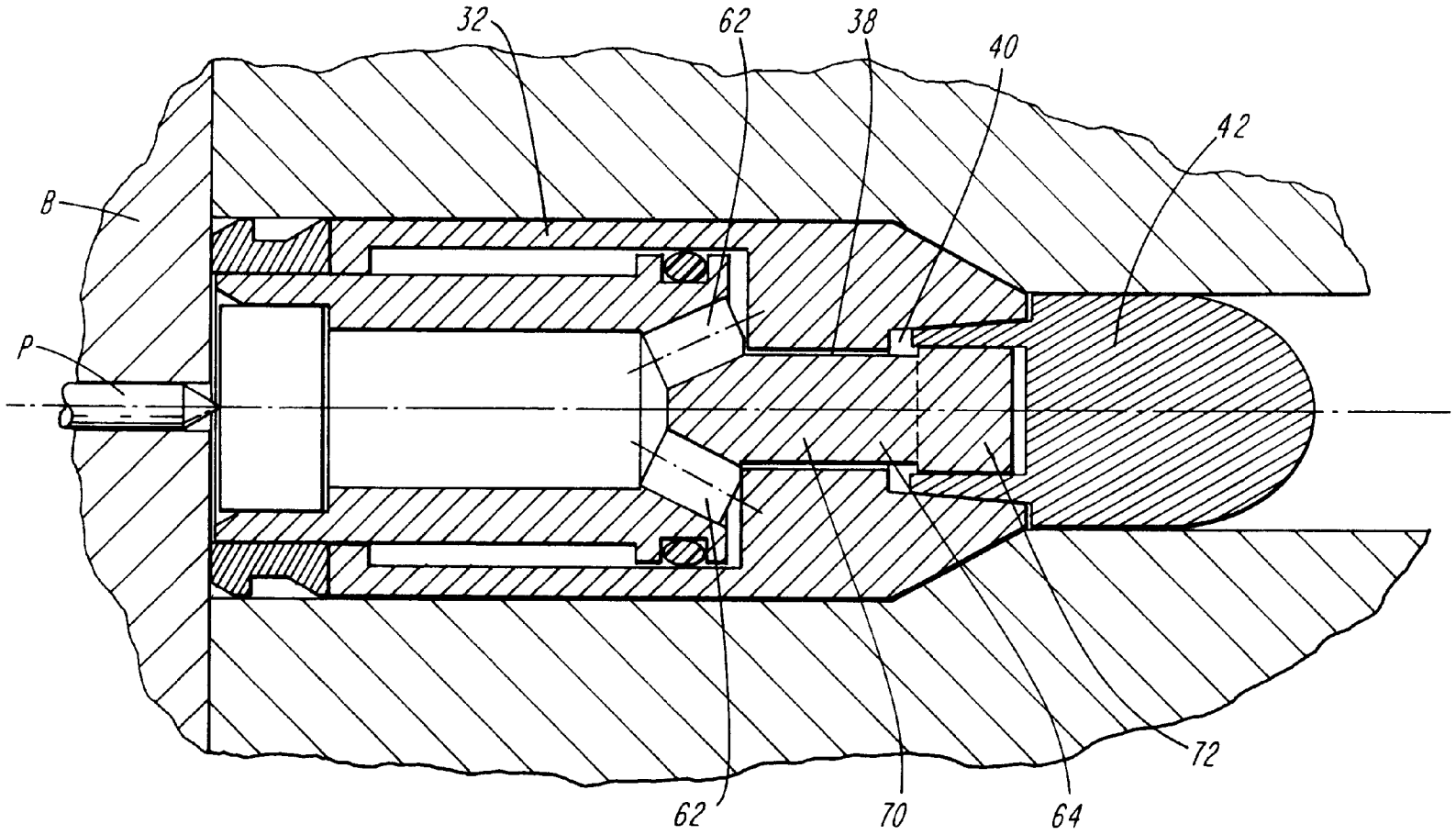
FIG. 2B is a longitudinal section through a gun cartridge, prior to firing, according to another embodiment of the present invention.

FIG. 2B illustrates an alternative spigot arrangement in the gun cartridge according to the present invention. In this embodiment, the spigot 64 does not contain a through gas passage 66 and outlet 68. Instead the spigot 64 has an axial section of reduced diameter 70. The reduced diameter section 70 opens out into the forward section 40 of the bore 38 prior to the cartridge being fired. Although not illustrated in this example, support ribs of a diameter equal to the head of the spigot 72, may surround section 70 to guide the valve spigot and prevent snagging.

Alternatively, the spigot may have an array of axial channels spaced around its circumference. The axial channels would open out into the forward section 40 of the bore 38 prior to the cartridge being fired.

On detonation of the pyrotechnic composition, expanding propellant gas flows from the first expansion chamber through the gas channels 62 into the second expansion chamber 48*a* between the head of the piston and the plug, and then along the section of spigot 70 of reduced diameter or containing axial channels in the wall of the spigot to the annular third expansion chamber 40*a*, thereby to discharge the bullet 42. As the pressurised gas forces the piston rearwardly with respect to the casing 32, the spigot section of reduced diameter or the outlets to the axial channels is/are blocked by the wall of the axial bore or gas passage 38 and gas is prevented from flowing into the third discharge chamber. Thereafter, substantially all the force of the propellant gas is used to propel the piston rearwardly against the breech block B to recycle the firearm as with the embodiment of FIGS. 2*a*, 3 and 4.

It is to be understood that the foregoing is merely exemplary of two embodiments of the invention and that modifications can be made thereto without departing from the scope of the invention.

What is claimed is:

1. A cartridge for use in a firearm, the cartridge having a projectile mounted in or on a nose portion thereof; the cartridge interior communicating with the projectile via a gas passage, valve means for controlling propellant gas flow through the gas passage, and a movable member which upon firing is propelled rearwardly from the cartridge against a breech block of the firearm by the pressure of propellant gas within the cartridge so as to recycle the firearm; characterised in that the valve means is arranged to close in order to stop or substantially reduce the flow of propellant gas through the said gas passage after the projectile has been fired from the cartridge, thereby to facilitate rearwards propulsion of the movable member.

2. A cartridge according to claim 1 wherein the movable member is in the form of a piston or cylinder slidably engaged respectively with a cylinder or piston extending rearwardly from the nose portion.

3. A cartridge according to claim 2 wherein the valve means is associated with the movable member.

4. A cartridge according to claim 3 wherein the movable member is in the form of a piston slidably received in a sleeve or cylinder extending rearwardly from the nose portion.

5. A cartridge according to claim 1 wherein the valve means is in the form of a spigot which is slidably received in the nose portion.

6. A cartridge according to claim 5 wherein the spigot is slidably received in a through bore in the nose portion, the through bore when not closed by the spigot forming the gas passage to the projectile.

7. A cartridge having a projectile mounted in or on a nose portion thereof, the nose portion having a gas passage therethrough communicating with a trailing surface of the projectile; a sleeve extending rearwardly from the nose portion, and a hollow piston slidably disposed within the sleeve; an expansion chamber being provided within the sleeve between the hollow piston and the nose portion, one or more gas channels being provided between the hollow interior of the piston and the expansion chamber; and valve means associated with the piston for closing the gas passage through the nose portion; wherein the valve means is configured such that it is in an open position prior to ignition of the cartridge, whereupon after ignition, expanding gas passing from the hollow interior of the piston through or around the valve means serves to expel the projectile, and expanding gas passing into the expansion chamber moves the piston rearwardly in the sleeve, the rearward movement of the piston causing the valve means to move to a closed position.

8. A cartridge according to claim 7 wherein the projectile is mounted in or on a recessed seat in the nose portion, and the gas passage communicates with the recessed seat.

9. A cartridge according to claim 8 wherein the valve means comprises a spigot which extends forwardly of the piston and into the gas passage.

10. A cartridge according to claim 9 wherein, in an open position, the spigot extends forwardly of the gas passage and into the recessed seat.

11. A cartridge according to claim 9 wherein the spigot has a leading end which is received within a recess in a trailing end of the projectile.

12. A cartridge according to claim 11 wherein the projectile has a hollow skirt portion at the trailing end thereof, the hollow skirt being defined by a generally cylindrical wall which is held as a force fit between the spigot and a radially inner wall of the recessed seat when the valve means is in an open position, prior to ignition of the cartridge.

13. A cartridge according to claim 12 wherein an annular chamber is formed between a trailing surface of the hollow skirt portion of the projectile, the spigot and a portion of the wall of the recessed seat, the annular chamber being in communication with the hollow interior of the piston when the valve means is in an open position.

14. A cartridge according to claim 13, wherein the spigot has a passage extending therethrough, the passage communicating with the hollow interior of the piston, and through which passage the expanding gas can pass when the valve means is in an open position, the passage through the spigot opening out into the annular chamber.

15. A cartridge according to claim 14 wherein the passage has an axially extending portion communicating with a lateral opening into the annular chamber, the lateral opening being open to permit the expanding gas to pass therethrough when the valve means is in an open position, and closed to prevent the expanding gas from passing therethrough when the valve means is in a closed position.

16. A cartridge according to claim 15 wherein the axially extending portion of the passage communicates with the lateral opening via a laterally extending passage.

17. A cartridge according to claim 16 wherein the laterally extending passage has a lateral opening at either end thereof into the annular chamber and the axially extending portion intersects the laterally extending passage at a point between the lateral openings.

18. A cartridge according to claim 17 wherein the axially extending portion intersects the laterally extending passage at a point midway between the lateral openings.

19. A cartridge according to claim 13 wherein the spigot is configured so as to allow expanding gas from the hollow interior of the piston to pass between a surface of the spigot and a wall of the gas passage through the nose portion into the annular chamber when the valve means is in an open position.

20. A cartridge according to claim 13 wherein rearwards movement of the piston and consequent rearwards movement of the spigot serves to block communication between the annular chamber and the hollow interior of the piston so as to prevent passage of expanding gas to the annular chamber.

21. A cartridge according to claim 9 wherein the spigot has a passage extending therethrough, the passage communicating with the hollow interior of the piston, and through which passage the expanding gas can pass when the valve means is in an open position.

22. A cartridge according to claim 9 wherein the spigot is configured so as to allow expanding gas from the hollow interior of the piston to pass between a surface of the spigot and a wall of the gas passage through the nose portion when the valve means is in an open position.

23. A cartridge according to claim 22 wherein the spigot has a portion which is undersized with respect to the gas passage such that there is a clearance therebetween through which the expanding gas can pass.

24. A cartridge according to claim 23 wherein the spigot is provided with an enlarged portion forwardly of the undersized portion, the enlarged portion fitting snugly in the gas passage to block the passage of gas when the valve means is in a closed position.

25. A cartridge according to claim 22 wherein the spigot has one or more channels extending along the outer surface thereof along which the expanding gas can pass, the channels for example communicating with the annular chamber when the valve means is in an open position.

26. A cartridge according to claim 25 wherein the channels are in the form of axial grooves.

27. A cartridge according to claim 22 wherein the spigot and piston are configured such that the expanding gas passes from the hollow interior of the piston into the gas passage in the nose portion via the expansion chamber.

28. A method of recycling a firearm comprising loading the firearm with a cartridge fitted with a projectile; the cartridge interior communicating with the projectile via a gas passage, valve means for controlling propellant gas flow through the gas passage, and a movable member which is propelled rearwardly from the cartridge against a breech block of the firearm by the pressure of propellant gas within the cartridge upon firing so as to recycle the firearm; characterised in that the valve means is arranged to close in order to stop or substantially reduce the flow of propellant gas through the said gas passage after the projectile has been fired from the cartridge.

29. A method according to claim 28 wherein the cartridge has a projectile mounted in or on a nose portion thereof and wherein said valve means is arranged to facilitate rearwards propulsion of the moveable member.

* * * * *